US009057969B2

(12) United States Patent
Nishida et al.

(10) Patent No.: US 9,057,969 B2
(45) Date of Patent: Jun. 16, 2015

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Tsutomu Nishida, Mishima (JP); Masato Tanaka, Tagata-gun (JP); Masataka Kawahara, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/167,848

(22) Filed: Jan. 29, 2014

(65) Prior Publication Data

US 2014/0212801 A1 Jul. 31, 2014

(30) Foreign Application Priority Data

Jan. 31, 2013 (JP) ..... 2013-017121

(51) Int. Cl.

| | |
|---|---|
| ***G03G 5/047*** | (2006.01) |
| ***G03G 7/00*** | (2006.01) |
| ***G03C 1/735*** | (2006.01) |

(52) U.S. Cl.
CPC *G03G 7/00* (2013.01); *G03C 1/735* (2013.01); *G03G 2215/00957* (2013.01)

(58) Field of Classification Search
CPC ..... G03G 5/10; G03G 5/04; G03G 5/067; G03G 5/0609
USPC ..... 430/56, 83
See application file for complete search history.

(56) References Cited

U.S. PATENT DOCUMENTS

| | | | |
|---|---|---|---|
| 5,538,827 | A | 7/1996 | Muramoto |
| 2011/0159420 | A1 | 6/2011 | Sakaguchi |

FOREIGN PATENT DOCUMENTS

| | | | |
|---|---|---|---|
| EP | 0735429 | A2 | 10/1996 |
| JP | 2006-072304 | A | 3/2006 |
| JP | 2006072304 | A | 3/2006 |
| JP | 2008-015428 | A | 1/2008 |

*Primary Examiner* — Hoa V Le

(74) *Attorney, Agent, or Firm* — Canon USA Inc, IP Division

(57) ABSTRACT

A photosensitive layer or a charge generation layer of an electrophotographic photosensitive member contains a gallium phthalocyanine and a particular diamine compound such as 1,2-diaminoethane or 1,3-diaminopropane. The content of the particular diamine compound in the photosensitive layer or the charge generation layer is from 10 ppm to 1,000 ppm (mass ratio) based on the gallium phthalocyanine.

14 Claims, 1 Drawing Sheet

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

1. Field of the Invention

The present invention relates to an electrophotographic photosensitive member, and a process cartridge and an electrophotographic apparatus that include an electrophotographic photosensitive member.

2. Description of the Related Art

Electrophotographic photosensitive members include various materials as charge generation materials. Among such materials, phthalocyanine pigments having high sensitivities are often used as charge generation materials for electrophotographic photosensitive members.

However, when the content of a phthalocyanine pigment in a photosensitive layer or a charge generation layer of an electrophotographic photosensitive member is increased in order to increase the sensitivity, dark attenuation tends to increase. The dark attenuation is a phenomenon in which, when a surface of an electrophotographic photosensitive member is charged, a surface potential of the electrophotographic photosensitive member decreases (attenuates) with time in a dark place. A large dark attenuation means that the degree of decrease (attenuation) in the surface potential of an electrophotographic photosensitive member in a dark place is large.

An increase in the dark attenuation causes a decrease in the image contrast, black dots, and background fogging, which may result in a decrease in the image quality.

Japanese Patent Laid-Open No. 2006-72304 discloses a technique in which a complex of a phthalocyanine pigment and an organic electron acceptor is produced by a particular method, and the dark attenuation is reduced by using the complex.

Japanese Patent Laid-Open No. 2008-15428 discloses a technique in which the dark attenuation is reduced by incorporating a particular salt and a particular charge generation material in a photosensitive layer.

However, according to studies conducted by the inventors of the present invention, the techniques disclosed in Japanese Patent Laid-Open Nos. 2006-72304 and 2008-15428 do not sufficiently reduce the dark attenuation in some cases.

SUMMARY OF THE INVENTION

The present invention provides an electrophotographic photosensitive member in which the dark attenuation is suppressed, and a process cartridge and an electrophotographic apparatus that include the electrophotographic photosensitive member.

A first aspect of the present invention provides an electrophotographic photosensitive member including a support, and a photosensitive layer formed on the support. The photosensitive layer contains a compound represented by the following formula (1) and a gallium phthalocyanine, and the content of the compound represented by the formula (1) in the photosensitive layer is from 10 ppm to 1,000 ppm (mass ratio) based on the gallium phthalocyanine.

$$H_2N—CH_2—R^1—CH_2—NH_2 \quad (1)$$

In the formula (1), $R^1$ represents a single bond or a substituted or unsubstituted alkylene group having 1 to 10 main-chain carbon atoms. A substituent of the substituted alkylene group is an alkyl group having 1 to 3 carbon atoms, an alkyl group having 1 to 3 carbon atoms and substituted with an amino group, or a hydroxy group. One of the carbon atoms in the main chain of the alkylene group may be replaced with an oxygen atom, a sulfur atom, or a bivalent group represented by the formula —$NR^2$—, and $R^2$ represents a hydrogen atom, an alkyl group having 1 to 3 carbon atoms, or an alkyl group having 1 to 3 carbon atoms and substituted with an amino group.

A second aspect of the present invention provides an electrophotographic photosensitive member including a support, and a photosensitive layer formed on the support, the photosensitive layer including a charge generation layer and a charge transport layer formed on the charge generation layer. The charge generation layer contains a compound represented by the formula (1) and a gallium phthalocyanine, and the content of the compound represented by the formula (1) in the charge generation layer is from 10 ppm to 1,000 ppm (mass ratio) based on the gallium phthalocyanine.

A third aspect of the present invention provides a process cartridge detachably attached to a main body of an electrophotographic apparatus. The process cartridge integrally supports the above electrophotographic photosensitive member, and at least one device selected from the group consisting of a charging device, a developing device, a transferring device, and a cleaning device.

A fourth aspect of the present invention provides an electrophotographic apparatus including the above electrophotographic photosensitive member, a charging device, an exposure device, a developing device, and a transferring device.

According to the aspects of the present invention, it is possible to provide an electrophotographic photosensitive member which has good electrophotographic characteristics and in which the dark attenuation is suppressed, and a process cartridge and an electrophotographic apparatus that include the electrophotographic photosensitive member.

Further features of the present invention will become apparent from the following description of exemplary embodiments with reference to the attached drawings.

DESCRIPTION OF THE EMBODIMENTS

Figure 1:
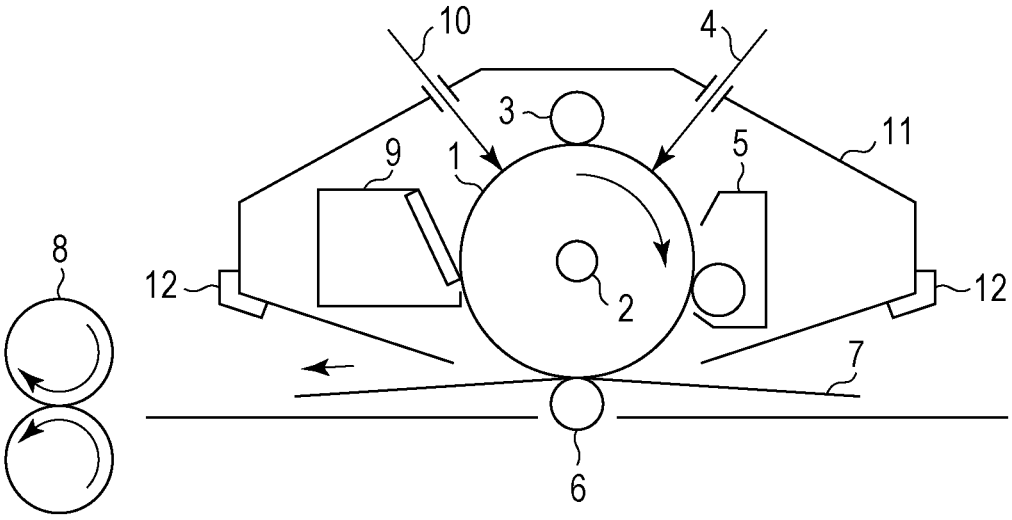
FIG. 1 is a view showing an example of a schematic structure of an electrophotographic apparatus that includes a process cartridge including an electrophotographic photosensitive member according to an embodiment of the present invention.

An electrophotographic photosensitive member according to an embodiment of the present invention includes a support, and a photosensitive layer formed on the support.

The photosensitive layer may be a single-layer-type photosensitive layer that contains a charge transport material and a charge generation material in a single layer. Alternatively, the photosensitive layer may be a multi-layer-type (function-separated-type) photosensitive layer that includes a charge generation layer containing a charge generation material and a charge transport layer containing a charge transport material. From the viewpoint of electrophotographic characteristics, the multi-layer-type photosensitive layer is preferable. The multi-layer-type photosensitive layer may be a regular layer-type photosensitive layer including a charge generation layer and a charge transport layer disposed on the charge generation layer. Alternatively, the multi-layer-type photosensitive layer may be a reverse layer-type photosensitive layer including a charge transport layer and a charge generation layer disposed on the charge transport layer. From the viewpoint of electrophotographic characteristics, the regular layer-type photosensitive layer is preferable.

The photosensitive layer or the charge generation layer of the electrophotographic photosensitive member according to an embodiment of the present invention contains a compound (diamine compound) represented by a formula (1) below, and a gallium phthalocyanine. The content of the compound represented by the formula (1) in the photosensitive layer or the charge generation layer is from 10 ppm to 1,000 ppm (mass ratio) based on the gallium phthalocyanine.

$$H_2N—CH_2—R^1—CH_2—NH_2 \quad (1)$$

In the formula (1), $R^1$ represents a single bond or a substituted or unsubstituted alkylene group having 1 to 10 main-chain carbon atoms. A substituent of the substituted alkylene group is an alkyl group having 1 to 3 carbon atoms, an alkyl group having 1 to 3 carbon atoms and substituted with an amino group, or a hydroxy group. One of the carbon atoms in the main chain of the alkylene group may be replaced with an oxygen atom, a sulfur atom, or a bivalent group represented by the formula —$NR^2$—, and $R^2$ represents a hydrogen atom, an alkyl group having 1 to 3 carbon atoms, or an alkyl group having 1 to 3 carbon atoms and substituted with an amino group.

Examples of the compound represented by the formula (1) include 1,2-diaminoethane (ethylenediamine), 1,3-diaminopropane, 1,4-diaminobutane, 1,5-diaminopentane, 1,6-diaminohexane, 1,7-diaminoheptane, 1,8-diaminooctane, 1,9-diaminononane, 1,10-diaminodecane, 1,11-diaminoundecane, 1,12-diaminododecane, 2-methyl-1,5-diaminopentane, diethylenetriamine, tris(2-aminoethyl) amine, 2,2'-thiobis(ethylamine), 1,2-diaminopropane, 1,2-diamino-2-methylpropane, 2-methyl-1,3-propanediamine, 1,3-diamino-2-propanol, 2,2-dimethyl-1,3-propanediamine, diethylenetriamine, 2,2'-oxybis(ethylamine), 2-methyl-1,5-diaminopentane, 2,2'-diamino-N-methyldiethylamine, 3,3'-diaminodipropylamine, bis(3-aminopropyl)ether, 3,3'-diamino-N-methyldipropyl amine, N,N'-bis(3-aminopropyl) ethylenediamine, ethylene glycol bis(3-aminopropyl)ether, tris(3-aminopropyl)amine, 1,4-butanediol bis(3-aminopropyl)ether, bis(hexamethylene)triamine, triethylenetetramine, 1,2-bis(2-aminoethoxy)ethane, N,N'-bis(2-aminoethyl)-1,3-propanediamine, 1,11-diamino-3,6,9-trioxaundecane, 2-(aminomethyl)-2-methyl-1,3-propanediamine, and tetraethylenepentamine. The compounds (solvents) represented by the formula (1) may be used alone or in combination of two or more compounds (solvents).

The inventors of the present invention believe as follows: The amino groups at both ends of the compound represented by the formula (1) easily form chelate bonds with gallium atoms of a gallium phthalocyanine. Therefore, the compound represented by the formula (1) functions as a spacer that suppresses aggregation of gallium phthalocyanine particles, and suppresses the formation of a long carrier path, in which the gallium phthalocyanine particles are continuously connected to each other, in the photosensitive layer or the charge generation layer. As a result, when a surface of an electrophotographic photosensitive member is charged, a surface potential of the electrophotographic photosensitive member does not easily decrease (attenuate). That is, the dark attenuation is suppressed. When the content of the compound represented by the formula (1) and contained in the photosensitive layer or the charge generation layer is less than 10 ppm based on the gallium phthalocyanine, the effect of suppressing the dark attenuation decreases. When the content of the compound represented by the formula (1) exceeds 1,000 ppm, the size of particles of a gallium phthalocyanine in the photosensitive layer or the charge generation layer becomes excessively small and the charge generation efficiency tends to decrease.

From the viewpoint described above, in an embodiment of the present invention, the content of the compound represented by the formula (1) and contained in the photosensitive layer or the charge generation layer is from 10 ppm to 1,000 ppm (mass ratio) based on the gallium phthalocyanine. The content of the compound represented by the formula (1) is particularly preferably from 20 ppm to 500 ppm (mass ratio).

Herein, the term "gallium phthalocyanine" refers to a phthalocyanine that contains a gallium atom as a central metal atom. Phthalocyanines that contain a gallium atom having a ligand (axial ligand) such as a chlorine atom or a hydroxy group are also covered by the gallium phthalocyanine. Furthermore, phthalocyanines that have a phthalocyanine ring having a substituent such as a halogen atom, e.g., a chlorine atom are also covered by the gallium phthalocyanine.

In the present invention, among gallium phthalocyanines, chlorogallium phthalocyanine and hydroxygallium phthalocyanine are preferable. Out of these, hydroxygallium phthalocyanine is more preferable. Chlorogallium phthalocyanine is a gallium phthalocyanine that contains a gallium atom having a chlorine atom as a ligand. Hydroxygallium phthalocyanine is gallium phthalocyanine that contains a gallium atom having a hydroxy group as a ligand. Out of chlorogallium phthalocyanine and hydroxygallium phthalocyanine, a gallium phthalocyanine represented by the following formula (2) is preferable. The gallium phthalocyanine represented by the formula (2) has a phthalocyanine ring which does not have a substituent.

(2)

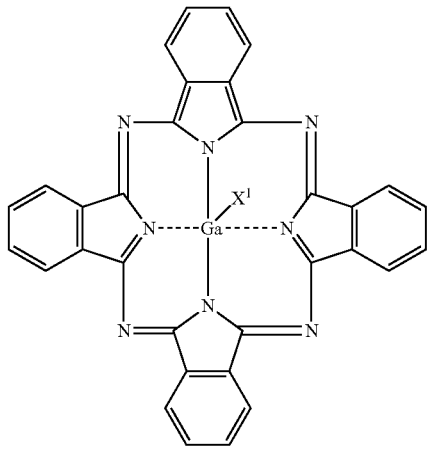

In the formula (2), $X^1$ represents a chlorine atom or a hydroxy group. $X^1$ is a ligand (axial ligand) of a gallium atom of the gallium phthalocyanine.

In hydroxygallium phthalocyanine, a hydroxygallium phthalocyanine crystal that has a crystal form having peaks at Bragg angles 2θ of 7.4°±0.3° and 28.3°±0.3° in CuKα characteristic X-ray diffraction is preferable.

The compound represented by the formula (1) preferably has a small molecular size because the number of moles contained in a certain mass is increased and a larger amount of the compound can act on a gallium phthalocyanine. Specifically, the group interposed between the two amino groups at both ends of the formula (1) is preferably a group having 5 or less main-chain atoms.

On the other hand, from the viewpoint of forming a better chelate bond with a gallium atom of a gallium phthalocyanine, a group having 3 or more main-chain atoms is preferably interposed between the two amino groups at both ends of the formula (1).

Accordingly, among the compounds represented by the formula (1), a compound represented by the following formula (1a) is preferable. Among the compounds represented by the formula (1), by using the compound represented by the formula (1a) below, the dark attenuation can be more satisfactorily suppressed.

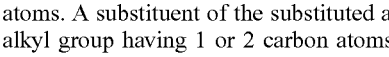

$$H_2N—CH_2—R^3—CH_2—NH_2 \quad (1a)$$

In the formula (1a), $R^3$ represents a substituted or unsubstituted alkylene group having 1 to 3 main-chain carbon atoms. A substituent of the substituted alkylene group is an alkyl group having 1 or 2 carbon atoms, or an alkyl group having 1 or 2 carbon atoms and substituted with an amino group. One of the carbon atoms in the main chain of the alkylene group may be replaced with an oxygen atom, a sulfur atom, or a bivalent group represented by the formula —$NR^4$—, and $R^4$ represents an alkyl group having 1 or 2 carbon atoms, or an alkyl group having 1 or 2 carbon atoms and substituted with an amino group.

The electrophotographic photosensitive member according to an embodiment of the present invention includes a support and a photosensitive layer as described above.

The support may be one having electric conductivity (conductive support). Examples of the support include supports composed of a metal (alloy) such as aluminum or stainless steel, and supports composed of a metal, a plastic, paper, or the like and having a conductive film on a surface thereof.

Examples of the shape of the support include a cylindrical shape and a film shape.

A conductive layer may be provided between the support and an undercoat layer described below or between the support and the photosensitive layer in order to cover unevenness and defects on the surface of the support and to suppress interference fringes, for example.

The conductive layer can be formed by applying a coating liquid for forming a conductive layer (hereinafter referred to as "conductive layer coating liquid") to form a coating film, the coating liquid being prepared by dispersing conductive particles such as carbon black, metal particles, or metal oxide particles in a solvent together with a binder resin, and drying and/or curing the coating film.

The thickness of the conductive layer is preferably 5 to 40 μm, and more preferably 10 to 30 μm.

An undercoat layer (also referred to as "intermediate layer") having a barrier function or an adhesion function may be provided between the support and the photosensitive layer or between the conductive layer and the photosensitive layer.

The undercoat layer can be formed by applying a coating liquid for forming an undercoat layer (hereinafter referred to as "undercoat layer coating liquid") to form a coating film, the coating liquid being prepared by dissolving a resin in a solvent, and drying and/or curing the coating film.

Examples of the resin used in the undercoat layer include polyvinyl alcohol, polyethylene oxide, ethyl cellulose, methyl cellulose, casein, polyamides, glue, and gelatin.

The thickness of the undercoat layer is preferably 0.3 to 5.0 μm.

When the photosensitive layer is a multi-layer-type photosensitive layer, a charge generation layer can be formed as follows: A coating liquid for forming a charge generation layer (hereinafter referred to as "charge generation layer coating liquid") is prepared by dispersing a gallium phthalocyanine serving as a charge generation material, a binder resin, and a compound represented by the formula (1) in a solvent. The charge generation layer coating liquid is applied to form a coating film, and the coating film is then dried and/or cured.

When the photosensitive layer is a single-layer-type photosensitive layer, the single-layer-type photosensitive layer can be formed as follows: A coating liquid for forming a photosensitive layer (hereinafter referred to as "photosensitive layer coating liquid") is prepared by dispersing a gallium phthalocyanine serving as a charge generation material, a charge transport material described below, a binder resin, and a compound represented by the formula (1) in a solvent. The photosensitive layer coating liquid is applied to form a coating film, and the coating film is then dried and/or cured.

The compound represented by the formula (1) may be incorporated in the charge generation layer coating liquid or the photosensitive layer coating liquid by using the compound represented by the formula (1) in a process of producing a gallium phthalocyanine. Alternatively, the compound represented by the formula (1) may be incorporated in the charge generation layer coating liquid or the photosensitive layer coating liquid by adding the compound represented by the formula (1) to a dispersion liquid prepared by dispersing a phthalocyanine and a binder resin in a solvent.

In the case where the compound represented by the formula (1) is used in a process of producing a gallium phthalocyanine, a washing step in the process is important. As described above, the inventors of the present invention believe that the compound represented by the formula (1) forms a chelate bond with a gallium atom of a gallium phthalocyanine. It is important that the amount of compound represented by the formula (1) used in the process of producing a gallium phthalocyanine be controlled until the amount becomes in the above preferred range (the content of the compound represented by the formula (1) in the photosensitive layer or the charge generation layer becomes in the range described above) in the washing step and a drying step of the gallium phthalocyanine. However, when a gallium phthalocyanine is dried at a high temperature, the charge generation efficiency of the gallium phthalocyanine may be decreased. Even when a gallium phthalocyanine is dried at a low temperature under a reduced pressure, it is difficult to control the amount of compound represented by the formula (1). That is, in the drying step of a gallium phthalocyanine, the amount of compound represented by the formula (1) is difficult to control. On the other hand, controlling the amount of compound represented by the formula (1) in the washing step of a gallium phthalocyanine is easier than controlling the amount in the drying step. In the washing step of a gallium phthalocyanine, in order to control the amount of compound represented by the formula (1) in the above preferred range, it is preferable to select, as a solvent for washing, a solvent having a solubility parameter (sp value), which is an index of compatibility, in a preferred range. For example, when the compound represented by the formula (1) is 1,2-diaminoethane (sp value: 12.3), a solvent having an sp value in the range of 11.3 to 13.3 is preferably used as a solvent for washing. An example of the solvent having an sp value in the range of 11.3 to 13.3 is N,N-dimethylformamide (sp value: 11.5).

When the photosensitive layer is a multi-layer-type photosensitive layer, the thickness of the charge generation layer is preferably 0.05 to 1 μm, and more preferably 0.15 to 0.4 μm.

When the photosensitive layer is a single-layer-type photosensitive layer, the thickness of the photosensitive layer is preferably 5 to 100 μm, and more preferably 10 to 40 μm.

When the photosensitive layer is a multi-layer-type photosensitive layer, the content of the charge generation material in the charge generation layer is preferably 30% to 90% by mass, and more preferably 50% to 80% by mass relative to the total mass of the charge generation layer.

When the photosensitive layer is a single-layer-type photosensitive layer, the content of the charge generation material in the photosensitive layer is preferably 0.1% to 40% by mass, and more preferably 0.4% to 10% by mass relative to the total mass of the photosensitive layer.

When the photosensitive layer is a multi-layer-type photosensitive layer, examples of the binder resin used in the charge generation layer include resins such as polyesters, acrylic resins, phenoxy resins, polycarbonate, polyvinyl butyral, polystyrene, polyvinyl acetate, polysulfones, polyarylates, vinylidene chloride, acrylonitrile copolymers, and polyvinyl benzal. Among these, polyvinyl butyral and polyvinyl benzal are preferable.

When the photosensitive layer is a multi-layer-type photosensitive layer, a charge transport layer can be formed as follows: A coating liquid for forming a charge transport layer (hereinafter referred to as "charge transport layer coating liquid") is prepared by dissolving a charge transport material and a binder resin in a solvent. The charge transport layer coating liquid is applied to form a coating film, and the coating film is then dried and/or cured.

When the photosensitive layer is a multi-layer-type photosensitive layer, the thickness of the charge transport layer is preferably 5 to 40 μm, and more preferably 10 to 25 μm.

When the photosensitive layer is a multi-layer-type photosensitive layer, the content of the charge transport material in the charge transport layer is preferably 20% to 80% by mass, and more preferably 30% to 60% by mass relative to the total mass of the charge transport layer.

When the photosensitive layer is a single-layer-type photosensitive layer, the content of the charge transport material in the photosensitive layer is preferably 20% to 50% by mass, and more preferably 30% to 40% by mass relative to the total mass of the photosensitive layer.

Examples of the charge transport material include triarylamine compounds, hydrazone compounds, stilbene compounds, pyrazoline compounds, oxazole compounds, thiazole compounds, and triarylmethane compounds. Among these, triaryl amine compounds are preferable.

When the photosensitive layer is a multi-layer-type photosensitive layer, examples of the binder resin used in the charge transport layer include resins such as polyesters, acrylic resins, phenoxy resins, polycarbonate, polystyrene, polyvinyl acetate, polysulfones, polyarylates, vinylidene chloride, and acrylonitrile copolymers. Among these, polycarbonates and polyarylates are preferable.

When the photosensitive layer is a single-layer-type photosensitive layer, examples of the binder resin used in the photosensitive layer include the above resins that can be used in the charge generation layer or the charge transport layer.

A protective layer may be provided on the photosensitive layer for the purpose of protecting the photosensitive layer.

The protective layer can be formed by applying a coating liquid for forming a protective layer (hereinafter referred to as "protective layer coating liquid") to form a coating film, the coating liquid being prepared by dissolving a resin in a solvent, and drying and/or curing the coating film. In the case where the coating film is cured, the coating film can be cured by, for example, heat, an electron beam, ultraviolet light, or the like. Examples of the resin include acrylic resins, methacrylic resins, polyvinyl butyral, polyesters, polycarbonate, nylons, polyimides, polyarylates, polyurethanes, styrene-butadiene copolymers, styrene-acrylic acid copolymers, and styrene-acrylonitrile copolymers.

The thickness of the protective layer is preferably 0.05 to 20 μm.

Examples of the method for applying a coating liquid for each layer include a dip coating method (dipping method), a spray coating method, a spinner coating method, a bead coating method, a blade coating method, and a beam coating method.

A layer serving as a surface layer of the electrophotographic photosensitive member may contain conductive particles, an ultraviolet absorber, and lubricating particles. Examples of the conductive particles include metal oxide particles such as tin oxide particles. Examples of the lubricating particles include fluorine atom-containing resin particles.

FIG. 1 illustrates an example of a schematic structure of an electrophotographic apparatus that includes a process cartridge including an electrophotographic photosensitive member according to an embodiment of the present invention.

Referring to FIG. 1, a cylindrical (drum-shaped) electrophotographic photosensitive member 1 is rotated about a shaft 2 in the direction shown by the arrow at a particular peripheral speed (process speed).

The surface (peripheral surface) of the electrophotographic photosensitive member 1 is charged to a particular positive or negative potential with a charging device (primary charging device) 3. Subsequently, the surface of the electrophotographic photosensitive member 1 is irradiated with exposure light (image exposure light) 4 from an exposure device (image exposure device) (not shown). Thus, an electrostatic latent image corresponding to desired image information is formed on the surface of the electrophotographic photosensitive member 1. The exposure light 4 is, for example, light whose intensity is modulated in accordance with a time-sequence electric digital image signal of the desired image information, the light being output from an exposure device such as a slit exposure or a laser beam scanning exposure.

The electrostatic latent image formed on the surface of the electrophotographic photosensitive member 1 is developed (subjected to normal development or reversal development) with a toner contained in a developing device 5. Thus, a toner image is formed on the surface of the electrophotographic photosensitive member 1. The toner image formed on the surface of the electrophotographic photosensitive member 1 is transferred to a transfer material (such as paper) 7 by a transferring device 6. At this time, a voltage having a polarity opposite to the charge of the toner is applied from a power supply (not shown) to the transferring device 6. In the case where the transfer material 7 is paper, the transfer material 7 is taken out from a paper feeding unit (not shown) and fed to a portion between the electrophotographic photosensitive member 1 and the transferring device 6 in synchronization with the rotation of the electrophotographic photosensitive member 1.

The transfer material 7 to which the toner image has been transferred from the electrophotographic photosensitive member 1 is detached from the surface of the electrophotographic photosensitive member 1 and conveyed to a fixing device 8 in which the toner image is fixed. Thus, the transfer material 7 is printed out as an image product (print or copy) to the outside of the electrophotographic apparatus.

The surface of the electrophotographic photosensitive member 1 after the transfer of the toner image to the transfer material 7 is cleaned with a cleaning device 9 by removing a substance such as a toner (toner that remains after the transfer), the substance adhering to the surface. In recent years, a cleaner-less system has also been developed, and a toner that remains after transfer may be removed by a developing device or the like. Furthermore, the charge on the surface of the electrophotographic photosensitive member 1 is erased with pre-exposure light 10 emitted from a pre-exposure device (not shown), and the electrophotographic photosensitive member 1 is then repeatedly used for forming images. In the case where the charging device 3 is a contact charging device that uses a charging roller or the like, the pre-exposure device is not necessarily provided.

In an embodiment of the present invention, a plurality of components selected from the electrophotographic photosensitive member 1, the charging device 3, the developing device 5, the cleaning device 9, etc., may be housed and integrally supported in a container to constitute a process cartridge 11. The process cartridge 11 may be detachably attached to a main body of an electrophotographic apparatus. For example, at least one device selected from the charging device 3, the developing device 5, and the cleaning device 9 may be integrally supported together with the electrophotographic photosensitive member 1 to constitute a process cartridge 11 which is detachably attached to the main body of the electrophotographic apparatus using a guiding unit 12 such as a rail of the main body of the electrophotographic apparatus.

In the case where the electrophotographic apparatus is a copying machine, the exposure light 4 may be reflected light or transmitted light from an original. Alternatively, the exposure light 4 may be light radiated by, for example, scanning of a laser beam, driving of an LED array, or driving of a liquid-crystal shutter array in accordance with a signal obtained by reading an original using a sensor and converting the resulting data into the signal.

The electrophotographic photosensitive member 1 according to an embodiment of the present invention can be widely applied to a copying machine, a laser beam printer, a CRT printer, an LED printer, a facsimile, a liquid crystal printer, laser plate making, etc.

EXAMPLES

The present invention will now be described in more detail using specific Examples. However, the present invention is not limited thereto. The thickness of each layer of electrophotographic photosensitive members of Examples and Comparative Examples was determined with an eddy-current instrument for measuring thickness (trade name: FISCHERSCOPE, manufactured by Fischer Instruments) or determined from a mass per unit area on a specific gravity basis. Gallium phthalocyanines used in Examples and Comparative Examples are gallium phthalocyanines each represented by the formula (2). In the description of Examples below, the term "parts" means "parts by mass".

Crystal Production Example 1

(1) First, 36.4 parts of o-phthalonitrile, 25 parts of gallium trichloride (2 moles relative to 4 moles of o-phthalonitrile), and 300 parts of α-chloronaphthalene were allowed to react in a nitrogen atmosphere at 200° C. for four hours to obtain a product. The product was then filtered at 130° C. The residual substance of the product on filter paper was washed by dispersion with N,N-dimethylformamide at 140° C. for two hours. The residual substance was then filtered again, washed with methanol, and then dried. Thus, 26.3 parts of chlorogallium phthalocyanine was obtained.

(2) Next, 15 parts of the chlorogallium phthalocyanine was dissolved in 450 parts of concentrated sulfuric acid at 10° C. The resulting solution was added dropwise to 2,300 parts of ice water under stirring to redeposit the chlorogallium phthalocyanine, and the precipitate was filtered. A residual substance on filter paper was washed by dispersion with a 2% aqueous ammonia, and then washed with ion-exchange water, and dried. Thus, 13 parts of low-crystalline hydroxygallium phthalocyanine was obtained.

(3) Next, a milling treatment of the low-crystalline hydroxygallium phthalocyanine was performed using N,N-dimethylformamide. Thus, a hydroxygallium phthalocyanine crystal that had a crystal form having peaks at Bragg angles 2θ of 7.4° and 28.3° in CuKα characteristic X-ray diffraction was obtained.

Crystal Production Example 2

In Crystal Production Example 1, 1 part of the low-crystalline hydroxygallium phthalocyanine obtained in (2) above was dissolved in 50 parts of 1,3-diaminopropane to prepare a dissolved liquid. This dissolved liquid was added dropwise to 500 parts of N,N-dimethylformamide, and the resulting mixture was then filtered. A residual substance on filter paper was washed with N,N-dimethylformamide. After the washing, solvent substitution was performed with tetrahydrofuran, and the residual substance was then dried under reduced pressure. Thus, a hydroxygallium phthalocyanine crystal that had a crystal form having peaks at Bragg angles 2θ of 7.4° and 28.3° in CuKα characteristic X-ray diffraction was obtained.

The hydroxygallium phthalocyanine crystal was dissolved in sulfuric acid-d2 solution (manufactured by Sigma-Aldrich). A $^{1}$H-NMR spectrum of this dissolved liquid was measured with a nuclear magnetic resonance spectrometer (JMN-EX400, manufactured by JEOL Ltd.). According to the results of the measurement, the proportion of 1,3-diaminopropane in the hydroxygallium phthalocyanine crystal (in the composition containing hydroxygallium phthalocyanine) was 436 ppm (mass ratio) relative to the hydroxygallium phthalocyanine in the crystal. The results are shown in Table 1.

Crystal Production Example 3

In Crystal Production Example 1, 1 part of the chlorogallium phthalocyanine obtained in (1) above was dissolved in 50 parts of 1,3-diaminopropane to prepare a dissolved liquid. This dissolved liquid was added dropwise to 500 parts of ion-exchange water and the resulting mixture was then filtered. A residual substance on filter paper was washed with N,N-dimethylformamide. After the washing, solvent substitution was performed with tetrahydrofuran, and the residual substance was then dried under reduced pressure. Thus, low-crystalline hydroxygallium phthalocyanine was obtained in which the ligand was substituted from a chlorine atom to a hydroxy group.

Next, a milling treatment of the low-crystalline hydroxygallium phthalocyanine was performed as in Crystal Production Example 1. Thus, a hydroxygallium phthalocyanine crystal that had a crystal form having peaks at Bragg angles 2θ of 7.4° and 28.3° in CuKα characteristic X-ray diffraction was obtained.

Crystal Production Example 4

A hydroxygallium phthalocyanine crystal that had a crystal form having peaks at Bragg angles 2θ of 7.4° and 28.3° in CuKα characteristic X-ray diffraction was obtained as in Crystal Production Example 2 except that 50 parts of 1,3-diaminopropane used in the preparation of the dissolved liquid in Crystal Production Example 2 was changed to 50 parts of 1,2-diaminoethane.

Crystal Production Example 5

A hydroxygallium phthalocyanine crystal that had a crystal form having peaks at Bragg angles 2θ of 7.4° and 28.3° in CuKα characteristic X-ray diffraction was obtained as in Crystal Production Example 3 except that 50 parts of 1,3-diaminopropane used in the preparation of the dissolved liquid in Crystal Production Example 3 was changed to 50 parts of 1,2-diaminoethane.

Crystal Production Example 6

A hydroxygallium phthalocyanine crystal that had a crystal form having peaks at Bragg angles 2θ of 7.4° and 28.3° in CuKα characteristic X-ray diffraction was obtained as in Crystal Production Example 3 except that 50 parts of 1,3-diaminopropane used in the preparation of the dissolved liquid in Crystal Production Example 3 was changed to 50 parts of 1,12-diaminododecane.

Crystal Production Example 7

A hydroxygallium phthalocyanine crystal that had a crystal form having peaks at Bragg angles 2θ of 7.4° and 28.3° in CuKα characteristic X-ray diffraction was obtained as in Crystal Production Example 1 except that N,N-dimethylformamide (sp value: 11.5) used in washing the residual substance on the filter paper by dispersion for two hours in Crystal Production Example 1 was changed to 1-methyl-2-pyrrolidone (sp value: 11.2).

Example 1

Production of Electrophotographic Photosensitive Member

An aluminum cylinder having a diameter of 24 mm and a length of 257.5 mm (JIS-A3003, aluminum alloy) was used as a support (cylindrical support).

Next, 60 parts of barium sulfate particles (trade name: Passtran PC1, manufactured by Mitsui Mining Smelting Co., Ltd.) coated with tin oxide, 15 parts of titanium oxide particles (trade name: TITANIXJR, manufactured by TAYCA Corporation), 43 parts of a resol-type phenolic resin (trade name: Phenolite J-325, manufactured by DIC Corporation, solid content 70% by mass), 0.015 parts of silicone oil (trade name: SH28PA, manufactured by Dow Corning Toray Silicone Co., Ltd.), 3.6 parts of silicone resin particles (trade name: TOSPEARL 120, manufactured by GE Toshiba Silicones), 50 parts of 2-methoxy-1-propanol, and 50 parts of methanol were put in a ball mill, and a dispersion treatment was conducted for 20 hours to prepare a conductive layer coating liquid. The conductive layer coating liquid was applied onto the support by dip coating. The resulting coating film was cured by heating at 140° C. for one hour to form a conductive layer having a thickness of 15 μm.

Next, 10 parts of a copolymerized nylon (trade name: Amilan CM8000, manufactured by Toray Industries, Inc.) and 30 parts of methoxymethylated 6-nylon (trade name: Toresin EF-30T, manufactured by Nagase ChemteX Corporation) were dissolved in a mixed solvent of 400 parts of methanol and 200 parts of n-butanol to prepare an undercoat layer coating liquid. The undercoat layer coating liquid was applied onto the conductive layer by dip coating. The resulting coating film was dried at 80° C. for six minutes to form an undercoat layer having a thickness of 0.45 μm.

Next, 1,000 parts of the hydroxygallium phthalocyanine crystal (charge generation material) prepared in Crystal Production Example 1, 500 parts of polyvinyl butyral (trade name: S-LEC BX-1, manufactured by Sekisui Chemical Co., Ltd.) and 25,000 parts of cyclohexanone were put in a sand mill containing glass beads having a diameter of 1 mm, and a dispersion treatment was conducted for six hours to prepare a dispersion liquid. Next, 25,000 parts of ethyl acetate and 0.25 parts of 1,3-diaminopropane were added to the dispersion liquid to prepare a charge generation layer coating liquid. The charge generation layer coating liquid was applied onto the undercoat layer by dip coating. The resulting coating film was dried at 100° C. for ten minutes to form a charge generation layer having a thickness of 0.25 μm.

Next, 80 parts of a compound (charge transport material (hole transport compound)) represented by a formula (3) below:

(3)

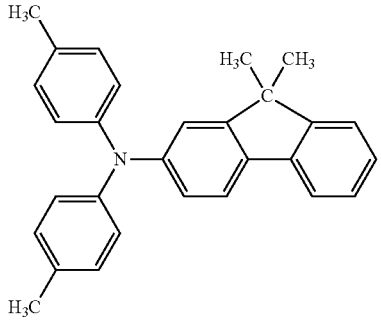

and 100 parts of a bisphenol Z-type polycarbonate (trade name: Iupilon 2200, manufactured by Mitsubishi Engineering-Plastics Corporation) were dissolved in a mixed solvent of 600 parts of monochlorobenzene and 200 parts of dimethoxymethane to prepare a charge transport layer coating liquid. The charge transport layer coating liquid was applied onto the charge generation layer by dip coating. The resulting coating film was dried at 120° C. for 30 minutes to form a charge transport layer having a thickness of 15 μm.

Thus, a cylindrical (drum-shaped) electrophotographic photosensitive member was produced.

Evaluation of Electrophotographic Photosensitive Member

Figure 2:
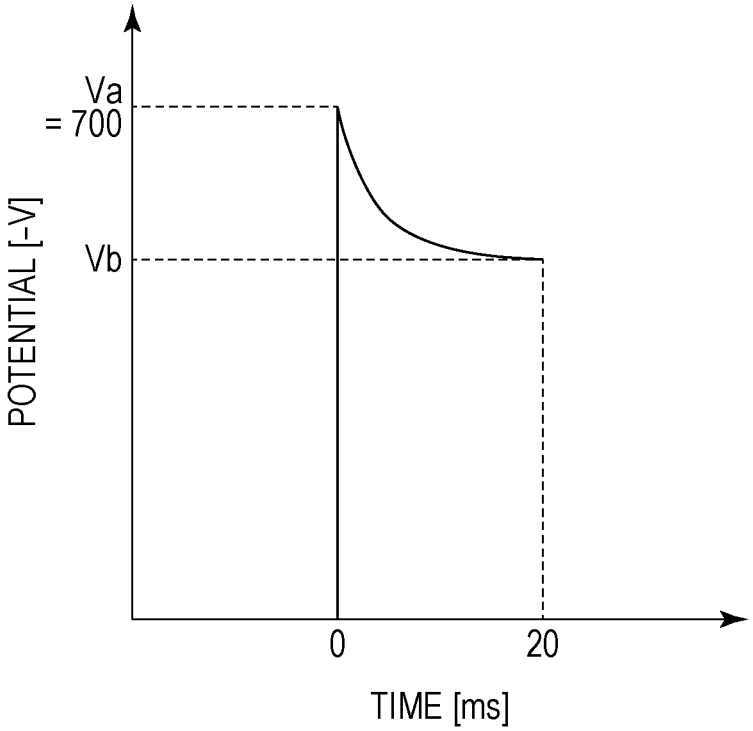
FIG. 2 is a graph that relates to an evaluation of a dark attenuation of an electrophotographic photosensitive member.

Electrophotographic characteristics of the electrophotographic photosensitive member produced as described above were measured with a direct voltage application-type electrophotographic photosensitive member measuring apparatus that uses curved NESA glass. Regarding a measurement sequence, a sequence of a capacitor model was used in which an electrophotographic photosensitive member was regarded as a capacitor. This measurement was performed as shown in FIG. 2. Specifically, first, in order to remove the hysteresis of the electrophotographic photosensitive member (hysteresis of potential), the entire surface of the electrophotographic photosensitive member was irradiated with light having a particular light quantity (1 μJ/cm$^2$). Ten milliseconds later of the irradiation, the surface of the electrophotographic photosensitive member was charged in a dark place so that the surface of the electrophotographic photosensitive member has a particular potential (Va [V]: −700 [V]). Twenty milliseconds later of the charging, a surface potential (Vb [V]) of the electrophotographic photosensitive member in the dark place was measured in the state where the electrophotographic photosensitive member was placed in the dark place. Next, a value Va−Vb [V] was determined, and this value was defined as a dark attenuation potential. The smaller the dark attenuation potential, the larger the effect of suppressing the dark attenuation.

Example 2

An electrophotographic photosensitive member was produced and evaluated as in Example 1 except that the charge generation layer coating liquid used in Example 1 was changed to a charge generation layer coating liquid prepared as described below. The results are shown in Table 1.

Preparation of Charge Generation Layer Coating Liquid

In a sand mill containing glass beads having a diameter of 1 mm, 1,000 parts of the hydroxygallium phthalocyanine crystal (charge generation material) prepared in Crystal Production Example 1, 500 parts of polyvinyl butyral (S-LEC BX-1), 25,000 parts of cyclohexanone, and 0.25 parts of 1,3-diaminopropane were put, and a dispersion treatment was conducted for six hours to prepare a dispersion liquid. Next, 25,000 parts of ethyl acetate was added to the dispersion liquid to prepare a charge generation layer coating liquid.

Example 3

An electrophotographic photosensitive member was produced and evaluated as in Example 2 except that the charge generation layer coating liquid used in Example 1 was changed to a charge generation layer coating liquid prepared as described below. The results are shown in Table 1.

Preparation of Charge Generation Layer Coating Liquid

In a sand mill containing glass beads having a diameter of 1 mm, 1,000 parts of the hydroxygallium phthalocyanine crystal (charge generation material) prepared in Crystal Production Example 2, 500 parts of polyvinyl butyral (S-LEC BX-1) and 25,000 parts of cyclohexanone were put, and a dispersion treatment was conducted for six hours to prepare a dispersion liquid. Next, 25,000 parts of ethyl acetate was added to the dispersion liquid to prepare a charge generation layer coating liquid.

After the evaluation of the electrophotographic photosensitive member of Example 3, only the photosensitive layer (including the charge generation layer and the charge transport layer) was peeled off from the electrophotographic photosensitive member. The photosensitive layer was dissolved in sulfuric acid-d2 solution (manufactured by Sigma-Aldrich). A $^{1}$H-NMR spectrum of this dissolved liquid was measured with a nuclear magnetic resonance spectrometer (JMN-EX400, manufactured by JEOL Ltd.). According to the results of the measurement, the proportion of 1,3-diaminopropane in the photosensitive layer (charge generation layer) was 436 ppm (mass ratio) relative to the hydroxygallium phthalocyanine in the photosensitive layer (charge generation layer). This value was the same as the proportion of 1,3-diaminopropane relative to the hydroxygallium phthalocyanine in the hydroxygallium phthalocyanine crystal, the proportion being measured in Crystal Production Example 2.

The proportion (mass ratio) of the compound represented by the formula (1) relative to the gallium phthalocyanine in the photosensitive layer (charge generation layer) of the electrophotographic photosensitive member in each of Comparative Examples and Examples other than Example 3 was measured by the above-described method including peeling off only the photosensitive layer (including the charge generation layer and the charge transport layer) from the electrophotographic photosensitive member.

Example 4

An electrophotographic photosensitive member was produced and evaluated as in Example 3 except that, in Example 3, the hydroxygallium phthalocyanine crystal prepared in Crystal Production Example 2 was changed to the hydroxygallium phthalocyanine crystal prepared in Crystal Production Example 3. The results are shown in Table 1.

Example 5

An electrophotographic photosensitive member was produced and evaluated as in Example 1 except that 0.25 parts of 1,3-diaminopropane used in the preparation of the charge generation layer coating liquid in Example 1 was changed to 0.25 parts of 1,5-diaminopentane. The results are shown in Table 1.

Example 6

An electrophotographic photosensitive member was produced and evaluated as in Example 1 except that 0.25 parts of 1,3-diaminopropane used in the preparation of the charge generation layer coating liquid in Example 1 was changed to 0.25 parts of 2-methyl-1,5-diaminopentane. The results are shown in Table 1.

Example 7

An electrophotographic photosensitive member was produced and evaluated as in Example 1 except that 0.25 parts of 1,3-diaminopropane used in the preparation of the charge generation layer coating liquid in Example 1 was changed to 0.25 parts of diethylenetriamine. The results are shown in Table 1.

Example 8

An electrophotographic photosensitive member was produced and evaluated as in Example 1 except that 0.25 parts of 1,3-diaminopropane used in the preparation of the charge generation layer coating liquid in Example 1 was changed to 0.25 parts of tris(2-aminoethyl)amine. The results are shown in Table 1.

Example 9

An electrophotographic photosensitive member was produced and evaluated as in Example 1 except that 0.25 parts of 1,3-diaminopropane used in the preparation of the charge generation layer coating liquid in Example 1 was changed to 0.25 parts of 1,2-diaminoethane. The results are shown in Table 1.

Example 10

An electrophotographic photosensitive member was produced and evaluated as in Example 2 except that 0.25 parts of 1,3-diaminopropane used in the preparation of the charge generation layer coating liquid in Example 1 was changed to 0.25 parts of 1,2-diaminoethane. The results are shown in Table 1.

Example 11

An electrophotographic photosensitive member was produced and evaluated as in Example 3 except that, in Example 3, the hydroxygallium phthalocyanine crystal prepared in Crystal Production Example 2 was changed to the hydroxygallium phthalocyanine crystal prepared in Crystal Production Example 4. The results are shown in Table 1.

Example 12

An electrophotographic photosensitive member was produced and evaluated as in Example 4 except that, in Example 4, the hydroxygallium phthalocyanine crystal prepared in Crystal Production Example 3 was changed to the hydroxygallium phthalocyanine crystal prepared in Crystal Production Example 5. The results are shown in Table 1.

Example 13

An electrophotographic photosensitive member was produced and evaluated as in Example 1 except that the amount of 1,3-diaminopropane used in the preparation of the charge generation layer coating liquid in Example 1 was changed from 0.25 parts to 0.02 parts. The results are shown in Table 1.

Example 14

An electrophotographic photosensitive member was produced and evaluated as in Example 1 except that the amount of 1,3-diaminopropane used in the preparation of the charge generation layer coating liquid in Example 1 was changed from 0.25 parts to 0.50 parts. The results are shown in Table 1.

Example 15

An electrophotographic photosensitive member was produced and evaluated as in Example 1 except that the amount of 1,3-diaminopropane used in the preparation of the charge generation layer coating liquid in Example 1 was changed from 0.25 parts to 0.01 parts. The results are shown in Table 1.

Example 16

An electrophotographic photosensitive member was produced and evaluated as in Example 1 except that the amount of 1,3-diaminopropane used in the preparation of the charge generation layer coating liquid in Example 1 was changed from 0.25 parts to 1.00 part. The results are shown in Table 1.

Example 17

An electrophotographic photosensitive member was produced and evaluated as in Example 3 except that, in Example 3, the hydroxygallium phthalocyanine crystal prepared in Crystal Production Example 2 was changed to the hydroxygallium phthalocyanine crystal prepared in Crystal Production Example 6. The results are shown in Table 1.

Example 18

An electrophotographic photosensitive member was produced and evaluated as in Example 1 except that 0.25 parts of 1,3-diaminopropane used in the preparation of the charge generation layer coating liquid in Example 1 was changed to 0.25 parts of 1,11-diamino-3,6,9-trioxaundecane. The results are shown in Table 1.

Comparative Example 1

An electrophotographic photosensitive member was produced and evaluated as in Example 9 except that the amount of 1,2-diaminoethane used in the preparation of the charge generation layer coating liquid in Example 9 was changed from 0.25 parts to 0.008 parts. The results are shown in Table 1.

Comparative Example 2

An electrophotographic photosensitive member was produced and evaluated as in Example 9 except that, in Example 9, the hydroxygallium phthalocyanine crystal prepared in Crystal Production Example 1 was changed to the hydroxygallium phthalocyanine crystal prepared in Crystal Production Example 7. The results are shown in Table 1.

Comparative Example 3

An electrophotographic photosensitive member was produced and evaluated as in Example 1 except that 0.25 parts of 1,3-diaminopropane used in the preparation of the charge generation layer coating liquid in Example 1 was changed to 0.25 parts of N,N-dimethylethylenediamine. The results are shown in Table 1.

TABLE 1

| | Compound represented by formula (1) | | Dark |
|---|---|---|---|
| | | Content* [ppm] | attenuation potential [−V] |
| Example 1 | 1,3-Diaminopropane | 250 | 19 |
| Example 2 | 1,3-Diaminopropane | 250 | 20 |
| Example 3 | 1,3-Diaminopropane | 436 | 18 |
| Example 4 | 1,3-Diaminopropane | 316 | 19 |
| Example 5 | 1,5-Diaminopentane | 250 | 20 |
| Example 6 | 2-Methyl-1,5-diaminopentane | 250 | 20 |
| Example 7 | Diethylenetriamine | 250 | 22 |
| Example 8 | Tris(2-aminoethyl)amine | 250 | 21 |
| Example 9 | 1,2-Diaminoethane | 250 | 23 |
| Example 10 | 1,2-Diaminoethane | 250 | 25 |
| Example 11 | 1,2-Diaminoethane | 246 | 23 |
| Example 12 | 1,2-Diaminoethane | 116 | 26 |
| Example 13 | 1,3-Diaminopropane | 20 | 27 |
| Example 14 | 1,3-Diaminopropane | 500 | 21 |
| Example 15 | 1,3-Diaminopropane | 10 | 29 |
| Example 16 | 1,3-Diaminopropane | 1000 | 19 |
| Example 17 | 1,12-Diaminododecane | 250 | 31 |
| Example 18 | 1,11-Diamino-3,6,9-trioxaundecane | 250 | 30 |
| Comparative Example 1 | 1,2-Diaminoethane | 8 | 35 |
| Comparative Example 2 | 1,2-Diaminoethane | 9240 | — |
| Comparative Example 3 | N,N-Dimethylethylenediamine | 250 | 34 |

*Content: Content (mass ratio) relative to gallium phthalocyanine in photosensitive layer (charge generation layer)

Regarding the electrophotographic photosensitive member of Comparative Example 2, the dark attenuation potential could not be measured.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-017121, filed Jan. 31, 2013, which is hereby incorporated by reference herein in its entirety.

What is claimed is:

1. An electrophotographic photosensitive member comprising:

a support; and a photosensitive layer formed on the support, wherein the photosensitive layer comprises:

a compound represented by the following formula (1); and a gallium phthalocyanine, and wherein, the content of the compound represented by the formula (1) in the photosensitive layer is from 10 ppm to 1,000 ppm (mass ratio) based on the gallium phthalocyanine, $$H_2N—CH_2—R^1—CH_2—NH_2 \quad (1)$$

wherein, in the formula (1), $R^1$ represents a single bond, a substituted or unsubstituted alkylene group having 1 to 10 main-chain carbon atoms, a substituent of the substituted alkylene group is an alkyl group having 1 to 3 carbon atoms, an alkyl group having 1 to 3 carbon atoms and substituted with an amino group, or a hydroxy group, one of the carbon atoms in the main chain of the alkylene group may be replaced with an oxygen atom, a sulfur atom, or a bivalent group represented by the formula —$NR^2$—, and $R^2$ represents a hydrogen atom, an alkyl group having 1 to 3 carbon atoms, or an alkyl group having 1 to 3 carbon atoms and substituted with an amino group.

2. The electrophotographic photosensitive member according to claim 1, wherein the content of the compound represented by the formula (1) in the photosensitive layer is from 20 ppm to 500 ppm (mass ratio).

3. The electrophotographic photosensitive member according to claim 1, wherein the gallium phthalocyanine is at least one gallium phthalocyanine selected from the group consisting of chlorogallium phthalocyanine and hydroxygallium phthalocyanine.

4. The electrophotographic photosensitive member according to claim 1, wherein the gallium phthalocyanine is a hydroxygallium phthalocyanine crystal that has a crystal form having peaks at Bragg angles 2θ of 7.4°±0.3° and 28.3°±0.3° in CuKα characteristic X-ray diffraction.

5. The electrophotographic photosensitive member according to claim 1, wherein the compound represented by the formula (1) is a compound represented by the following formula (1a):

$$H_2N—CH_2—R^3—CH_2—NH_2 \quad (1a)$$

wherein, in the formula (1a), $R^3$ represents a substituted or unsubstituted alkylene group having 1 to 3 main-chain carbon atoms, a substituent of the substituted alkylene group is an alkyl group having 1 or 2 carbon atoms or an alkyl group having 1 or 2 carbon atoms and substituted with an amino group, one of the carbon atoms in the main chain of the alkylene group may be replaced with an oxygen atom, a sulfur atom, or a bivalent group represented by the formula —$NR^4$—, and $R^4$ represents an alkyl group having 1 or 2 carbon atoms or an alkyl group having 1 or 2 carbon atoms and substituted with an amino group.

6. A process cartridge detachably attached to a main body of an electrophotographic apparatus, wherein the process cartridge integrally supports:

the electrophotographic photosensitive member according to claim 1, and at least one device selected from the group consisting of a charging device, a developing device, a transferring device, and a cleaning device.

7. An electrophotographic apparatus comprising:

the electrophotographic photosensitive member according to claim 1;

a charging device;

an exposure device;

a developing device; and a transferring device.

8. An electrophotographic photosensitive member comprising:

a support; and a photosensitive layer formed on the support, the photosensitive layer comprising a charge generation layer and a charge transport layer formed on the charge generation layer, wherein the charge generation layer comprises:

a compound represented by the following formula (1); and a gallium phthalocyanine, and wherein, the content of the compound represented by the formula (1) in the charge generation layer is from 10 ppm to 1,000 ppm (mass ratio) based on the gallium phthalocyanine, $$H_2N—CH_2—R^1—CH_2—NH_2 \quad (1)$$

wherein, in the formula (1), $R^1$ represents a single bond, a substituted or unsubstituted alkylene group having 1 to 10 main-chain carbon atoms, a substituent of the substituted alkylene group is an alkyl group having 1 to 3 carbon atoms, an alkyl group having 1 to 3 carbon atoms and substituted with an amino group, or a hydroxy group, one of the carbon atoms in the main chain of the alkylene group may be replaced with an oxygen atom, a sulfur atom, or a bivalent group represented by the formula —$NR^2$—, and $R^2$ represents a hydrogen atom, an alkyl group having 1 to 3 carbon atoms, or an alkyl group having 1 to 3 carbon atoms and substituted with an amino group.

9. The electrophotographic photosensitive member according to claim 8, wherein the content of the compound represented by the formula (1) in the charge generation layer is from 20 ppm to 500 ppm (mass ratio).

10. The electrophotographic photosensitive member according to claim 8, wherein the gallium phthalocyanine is at least one gallium phthalocyanine selected from the group consisting of chlorogallium phthalocyanine and hydroxygallium phthalocyanine.

11. The electrophotographic photosensitive member according to claim 8, wherein the gallium phthalocyanine is a hydroxygallium phthalocyanine crystal that has a crystal form having peaks at Bragg angles 2θ of 7.4°±0.3° and 28.3°±0.3° in CuKα characteristic X-ray diffraction.

12. The electrophotographic photosensitive member according to claim 8, wherein the compound represented by the formula (1) is a compound represented by the following formula (1a):

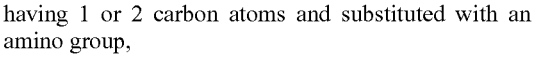

$$H_2N—CH_2—R^3—CH_2—NH_2 \quad (1a)$$

wherein, in the formula (1a), $R^3$ represents a substituted or unsubstituted alkylene group having 1 to 3 main-chain carbon atoms, a substituent of the substituted alkylene group is an alkyl group having 1 or 2 carbon atoms or an alkyl group having 1 or 2 carbon atoms and substituted with an amino group, one of the carbon atoms in the main chain of the alkylene group may be replaced with an oxygen atom, a sulfur atom, or a bivalent group represented by the formula $—NR^4—$, and $R^4$ represents an alkyl group having 1 or 2 carbon atoms or an alkyl group having 1 or 2 carbon atoms and substituted with an amino group.

13. A process cartridge detachably attached to a main body of an electrophotographic apparatus, wherein the process cartridge integrally supports:

the electrophotographic photosensitive member according to claim 8, and at least one device selected from the group consisting of a charging device, a developing device, a transferring device, and a cleaning device.

14. An electrophotographic apparatus comprising:

the electrophotographic photosensitive member according to claim 8;

a charging device;

an exposure device;

a developing device; and a transferring device.

* * * * *